US007744313B2

(12) United States Patent
Terai et al.

(10) Patent No.: US 7,744,313 B2
(45) Date of Patent: Jun. 29, 2010

(54) FIXED SECURITY BARRIER

(76) Inventors: Jeffrey B. Terai, 1478 Theresa St., Carpinteria, CA (US) 93013; James M. McDole, 361 Borchard Dr., Ventura, CA (US) 93003

( * ) Notice: Subject to any disclaimer, the term of this patent is extended or adjusted under 35 U.S.C. 154(b) by 203 days.

(21) Appl. No.: 11/833,193

(22) Filed: Aug. 2, 2007

(65) Prior Publication Data

US 2009/0035068 A1 Feb. 5, 2009

(51) Int. Cl.
*B63G 9/00* (2006.01)

(52) U.S. Cl. ..... 405/211; 114/241; 114/240 E

(58) Field of Classification Search ..... 405/211, 405/21, 25, 60, 80, 107; 114/241, 240 R, 114/240 A, 240 C–240 E; 404/6, 9, 10; 49/49; 256/13.1

See application file for complete search history.

(56) References Cited

U.S. PATENT DOCUMENTS

| | | | | |
|---|---|---|---|---|
| 1,151,607 | A | 8/1915 | Newhall et al. | |
| 1,772,888 | A | 8/1930 | Elia | |
| 2,369,464 | A | 2/1945 | Kalnitz | |
| 2,404,612 | A | 7/1946 | Bannerman | |
| 2,408,367 | A | 10/1946 | Brickman | |
| 2,408,482 | A | 10/1946 | Riddle | |
| 2,465,936 | A | 3/1949 | Schultz | |
| 3,454,244 | A | 7/1969 | Walander | |
| 3,537,587 | A | 11/1970 | Kain | |
| 3,810,595 | A | 5/1974 | Doolittle | |
| 3,827,660 | A * | 8/1974 | Doolittle | 244/110 C |
| 3,845,633 | A | 11/1974 | Hammond | |
| 4,135,467 | A | 1/1979 | Loire et al. | |

(Continued)

FOREIGN PATENT DOCUMENTS

| | | |
|---|---|---|
| FR | 2675828 | 10/1992 |

(Continued)

OTHER PUBLICATIONS

Notification of Transmittal and International Search Report and Written Opinion of the International Search Authority for PCT application PCT/US08/71928, dated Feb. 25, 2009, 16 pages.

*Primary Examiner*—Tara Mayo-Pinnock
*Assistant Examiner*—Benjamin Fiorello
(74) *Attorney, Agent, or Firm*—Kristin C. Hiibner; Sheldon Mak Rose & Anderson PC

(57) ABSTRACT

A barrier for stopping unwanted watercraft and subsurface intruders from entering into a port or off-shore structure is provided. In one embodiment, the invention is a barrier comprised of a vertical net structure supported from the sea floor. The barrier comprises vertical supports and a net assembled between the vertical supports with a system of ropes and energy absorbing devices. The structural components of the barrier are designed and configured in a manner as to absorb and displace the kinetic energy generated by an explosive laden small watercraft traveling at a high rate of speed. In another embodiment, invention is a barrier system installed around the perimeter of a water side or offshore facility. This barrier system comprises a bottom founded perimeter fence having a gate system and a series of barriers comprised of a vertical fence structure supported from the sea floor. This barrier system is designed to control access and to protect a water side or offshore facility from potential terrorism threats.

19 Claims, 10 Drawing Sheets

U.S. PATENT DOCUMENTS

| | | | | |
|---|---|---|---|---|
| 4,398,848 | A | 8/1983 | Guilbeau | |
| 5,224,800 | A | 7/1993 | Mogridge et al. | |
| 5,524,875 | A * | 6/1996 | Thommen, Jr. | 256/12.5 |
| 5,961,099 | A | 10/1999 | Thommen, Jr. | |
| 6,533,495 | B1 | 3/2003 | Williams et al. | |
| 6,681,709 | B1 | 1/2004 | Nixon et al. | |
| 6,778,469 | B1 * | 8/2004 | McDonald | 367/136 |
| 6,843,197 | B1 | 1/2005 | Nixon et al. | |
| 6,905,283 | B1 | 6/2005 | Salyer, Sr. | |
| 7,063,484 | B2 | 6/2006 | Meeks et al. | |
| 7,140,599 | B1 | 11/2006 | Spink | |
| 7,140,802 | B2 | 11/2006 | Lamore | |
| 2006/0239774 | A1 | 10/2006 | Williams et al. | |
| 2006/0286342 | A1 | 12/2006 | Elzey | |
| 2007/0133350 | A1 | 6/2007 | McDonald | |

FOREIGN PATENT DOCUMENTS

| | | |
|---|---|---|
| GB | 23489 | 9/1915 |
| GB | 2402369 | 12/2004 |
| WO | 2006083429 | 8/2006 |

* cited by examiner

FIXED SECURITY BARRIER

BACKGROUND

Harbors and other waterfront and off-shore structures are vulnerable to attack by small watercraft, i.e., vehicles, vessels or crafts that move across or through water, such as a speedboat. These watercraft are common in the water and are used for many purposes such as for pleasure, recreation, physical exercise, commerce, transport of people, and goods. It is difficult to distinguish recreational watercraft from a hostile watercraft, such as, a watercraft loaded with explosives that is designed to detonate and cause harm to people, structures, and other watercraft. A small hostile watercraft can potentially slip into a harbor or other waterfront structure unnoticed or otherwise undeterred and cause severe damage to people and property.

Near shore, port, and off-shore barriers are known. Examples of such barriers are described in U.S. Pat. Nos. 4,135,467, 6,681,709, and 6,843,197. These barriers consist of low freeboard float lines or log booms that mark a restricted area, or higher freeboard barriers fabricated of molded plastic or inflated rubber tubes. A port security barrier (PSB) comprised of continuous modular, floating barrier that is installed in lengths ranging from a few hundred feet to over a mile is also known. Each PSB module of the PSB system includes a capture net fabricated from nylon or other synthetic line and net support structure which operates to stop the waterborne craft and prevent entry into the port. However, these barriers suffer from one or more of the disadvantages of being ineffective against higher speed watercraft, are floating and subject to below water level threats such as swimmers, divers, and torpedoes, have unsuitable damage from the impact of a watercraft, have high maintenance costs, and/or are unreliable in the wind, waves, currents, storms and other harsh environmental conditions at sea.

Therefore, there is a need for a barrier system that is effective against high speed watercraft, can provide protection from subsurface threats, is resistant to environmental energies and damage from attacking watercraft, and has lower maintenance costs.

SUMMARY

In one embodiment of the invention, a barrier comprising bottom founded supports and a system of ropes, energy absorbing devices, and a net is provided. The invention satisfies the above-identified needs in that the barrier can effectively stop a high speed watercraft in a short distance, with minimal damage to the barrier and watercraft. The barrier also may be extended to the bottom of the sea floor or other body of water which provides protection from subsurface threats such as swimmers, divers, and torpedoes. The barrier, being grounded to the base of a water body is resistant to environmental energies, such as high wind, waves, currents, and storms, and has lower maintenance costs.

In one embodiment, the barrier comprises a first end support, a second end support, a top rope connected to the first end support and the second end support, a first upper rope connected to the first end support and the second end support, and a second upper rope connected to the first end support and the second end support. The supports may be single supports, or preferably, one or both of the first end support and the second end support comprise a set of first and second vertical support members which are coupled together. A plurality of hanger ropes connect the top rope to the first upper rope and the second upper rope, and a plurality of energy absorption devices, which dissipate residual energy out of the net, are connected to one or both of the first upper rope and the second upper rope. The barrier also has first and second bottom ropes which are connected to the first and second end supports, and a plurality of energy absorption devices, which dissipate residual energy out of the net, connected to one or both of the first bottom rope and the second bottom rope. A net having a top, a bottom, a first side, and a second side is connected to the ropes. The top of the net is connected to the first upper rope and the second upper rope and the bottom of the net is connected to the first bottom rope and the second bottom rope, such that the first side of the net is proximate to the first end support and the second side of the net is proximate to the second end support. Preferably, the first and second supports are driven into the base of a body of water and the bottom of the net extends to the base of the water body, such as the sea floor. The barrier also has first and second vertical ropes, which are connected to the first side of the net and the second side of the net, respectively. The net may be formed from a series of net segments comprised of first and second net segments which are connected to each other to form a larger net, which is then connected to the ropes and supports as described above.

In a preferred embodiment, at least one of the energy absorption devices is a braking device. More preferably, at least one braking device is connected to the first upper rope at a position proximate to the first end support, and at least one braking device is connected to the second upper rope at a position proximate to the second end support, at least one braking device is connected to the first bottom rope at a position proximate to the first end support, and at least one braking device is connected to the second bottom rope at a position proximate to the second end support. Most preferably, the barrier has eight braking devices attached to the first and second upper ropes, four on each end proximate to the end supports, and eight braking devices attached to the first and second bottom ropes, four on each end proximate to the end supports.

In a preferred embodiment, the net is comprised of nylon, steel or another alloy. More preferably, the net is comprises a diamond-shaped mesh pattern, and/or a rectangular mesh pattern, and/or a plurality of interconnecting rings.

In another embodiment of the invention, the barrier is a system comprising a plurality of contiguous barrier units that form a perimeter. At least one barrier unit is a barrier according to the present invention, at least one barrier unit operates as an access gate. The barrier system may also have electronic surveillance, electronic tracking for monitoring the approach of an aqueous vehicle. In one embodiment of the barrier system, the contiguous barrier units form a substantially circular perimeter around an off shore structure. In another embodiment, the access gate is a floating barrier gate, and/or a vertical action gate, which may be remotely operated.

In another embodiment, the invention is a method for stopping a high speed watercraft in a body of water. According to this method, a comprising a net assembled between at least two vertical supports with a system of ropes and energy absorbing devices is provided. The vertical supports are in a stationary position and are substantially perpendicular to the body of water. A watercraft is then moved at a high rate of speed in a direction substantially perpendicular to the barrier, thereby generating a kinetic energy. The net is then contacted with the watercraft, which dissipates at least some of the kinetic energy into the net. Then, the watercraft is vertically pitched, in relation to the body of water, thereby converting at least some of the kinetic energy. The watercraft is then stopped by the barrier, and may slide back into the water where it may at least partially be submerged in the body of water. According to the present invention, the barrier and the watercraft are substantially undeformed, and the vertical supports are substantially unmoved from the stationary position after contact from the oncoming watercraft.

FIGURES

These and other features, aspects and advantages of the present invention will become better understood from the following description, appended claims, and accompanying figures where:

Figure 4A:
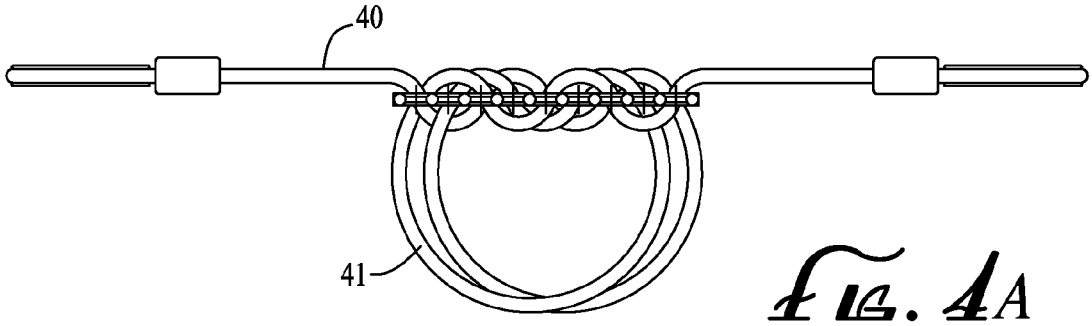
Figure 4B:
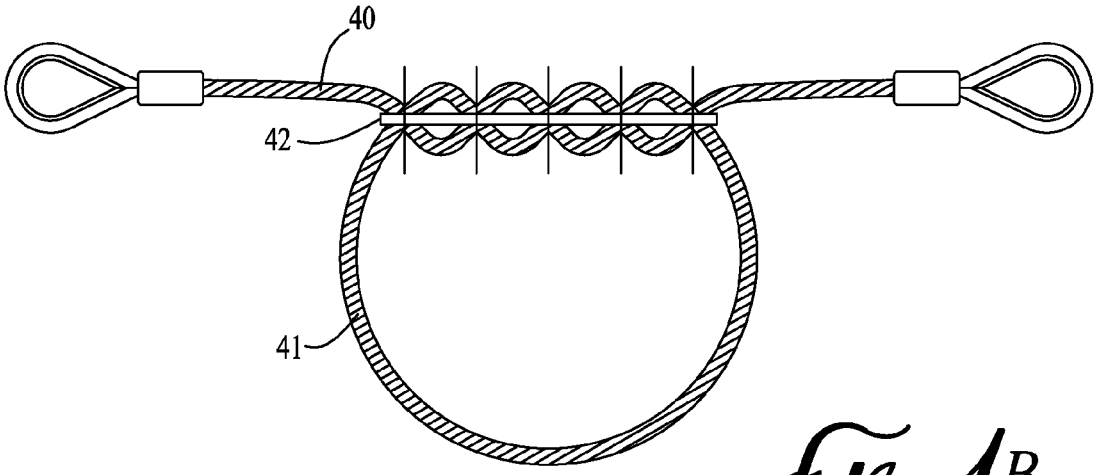
Figure 4C:
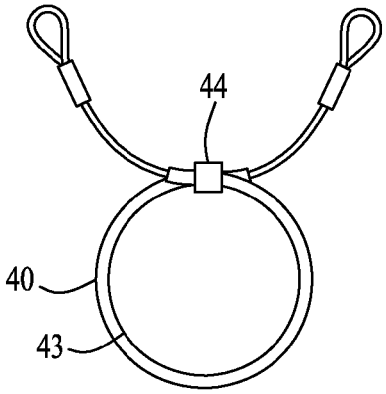
Figure 4D:
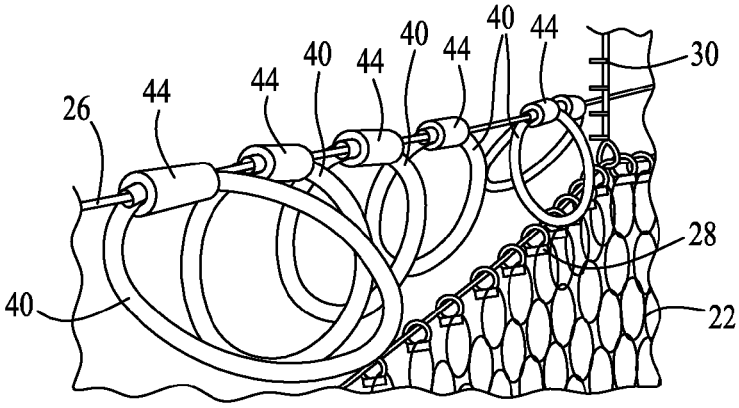
Figure 4E:
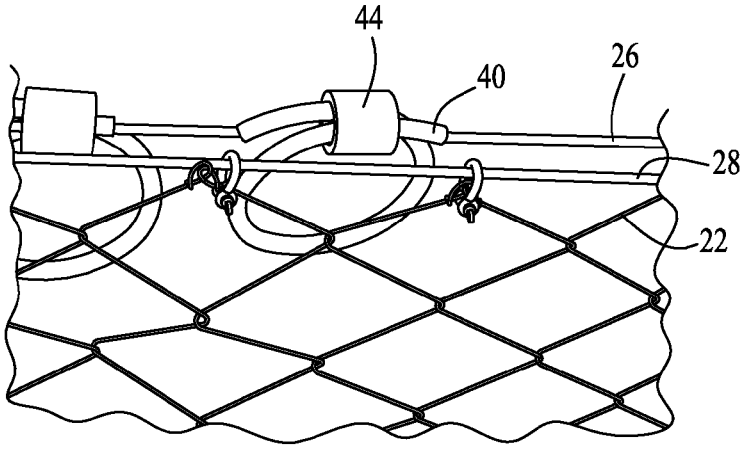
Figure 6A:
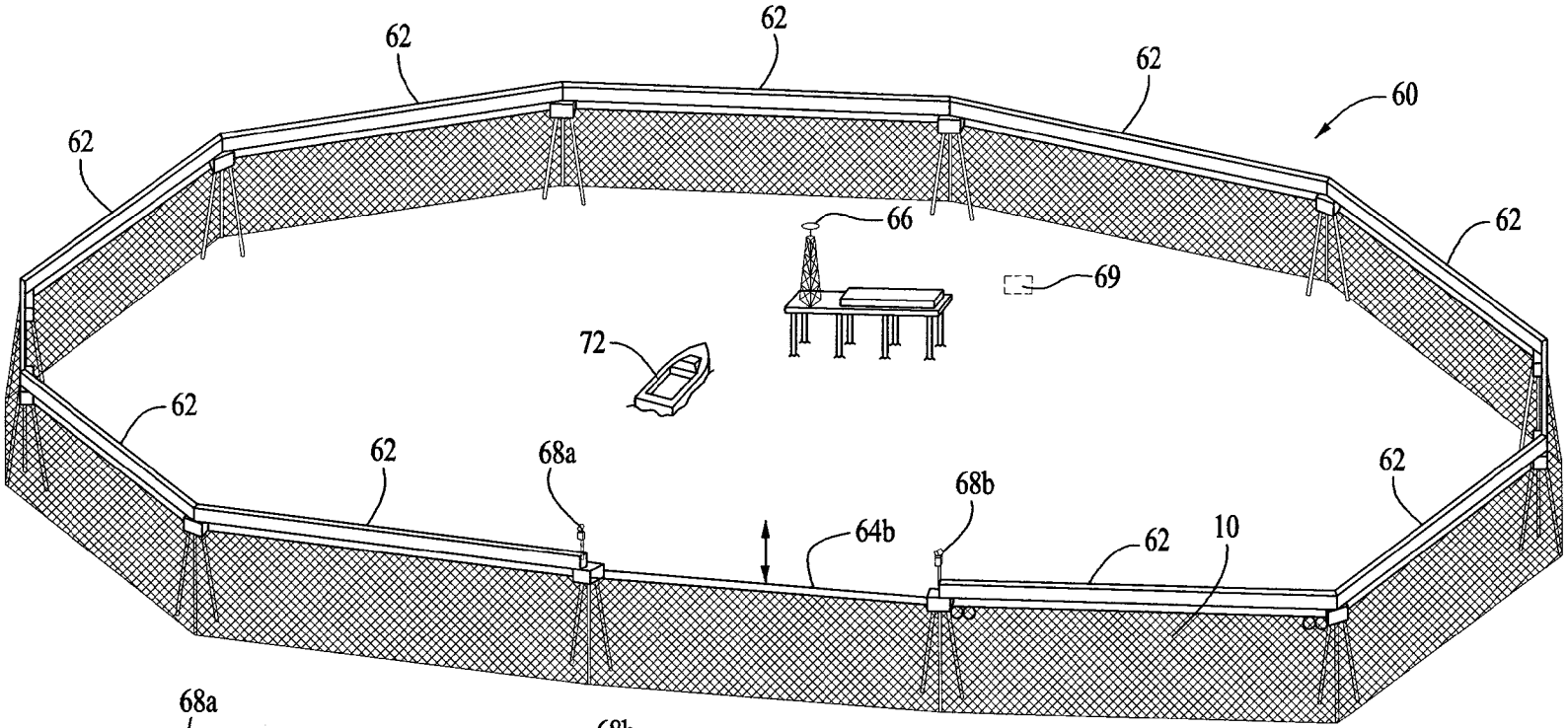
Figure 6B:
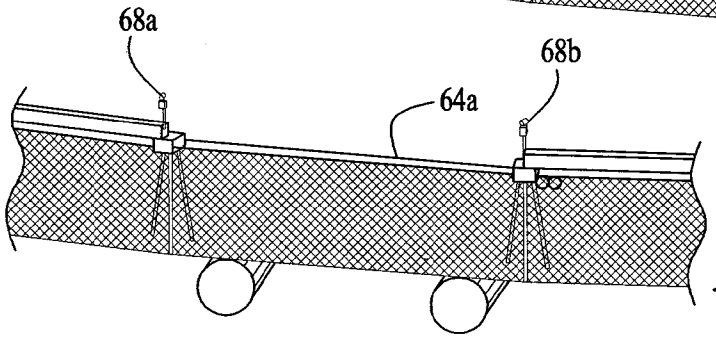

FIGS. 4*a*, 4*b*, and 4*c*, are front view illustrations of various embodiments of energy absorbing devices according to the invention;

FIG. 4*d* is a side perspective view of a barrier, showing a plurality of energy absorbing devices according to the invention;

FIG. 4*e* is a front perspective view of a barrier, showing a plurality of energy absorbing devices and a net according to the invention;

FIGS. 5*a*-5*f*, are front view illustrations of various embodiments of a net according to the invention;

FIG. 6*a* and 6*b* are top side perspective illustration of a barrier system according to one embodiment of the invention; and FIGS. 7*a*-7*f*, are side perspective illustrations of a watercraft approaching, contacting, and being stopped, respectively, by a barrier according to the invention.

DESCRIPTION

According to one embodiment of the present invention, a barrier for stopping unwanted watercraft and subsurface intruders from entering into a port or off-shore structure is provided. The barrier comprises a vertical net structure supported from the floor of a body of water, such as a sea floor, or the floor of a lake, dam, large river, or other bodies of water that are navigable by a small watercraft. The net structure is a substantially vertical structure, and is comprised of vertical supports and a net assembled between the vertical supports with a system of ropes and energy absorbing devices. The structural components of the barrier are designed and configured in a manner as to absorb and displace the kinetic energy generated by an explosive laden small watercraft traveling at a high rate of speed. The barrier according to the present invention prevents small watercraft carrying explosives or the like from damaging such valuable assets as oil pumping platforms, commercial ports, harbors and offshore drilling facilities. In the past port security barriers have primarily consisted of a flotation device that supports the net system. These flotation devices are subject to environmental energies which create high maintenance costs, and are unreliable. The barrier according to the present invention has bottom founded components (i.e., grounded to the floor of a body of water), which significantly reduces environmental energies and maintenance costs. Additional protection is created by the barrier according to the present invention by having a net that extends to the floor of the body of water (e.g., the sea floor), thereby providing protection from subsurface threats such as swimmers, divers, and torpedoes.

Figure 1:
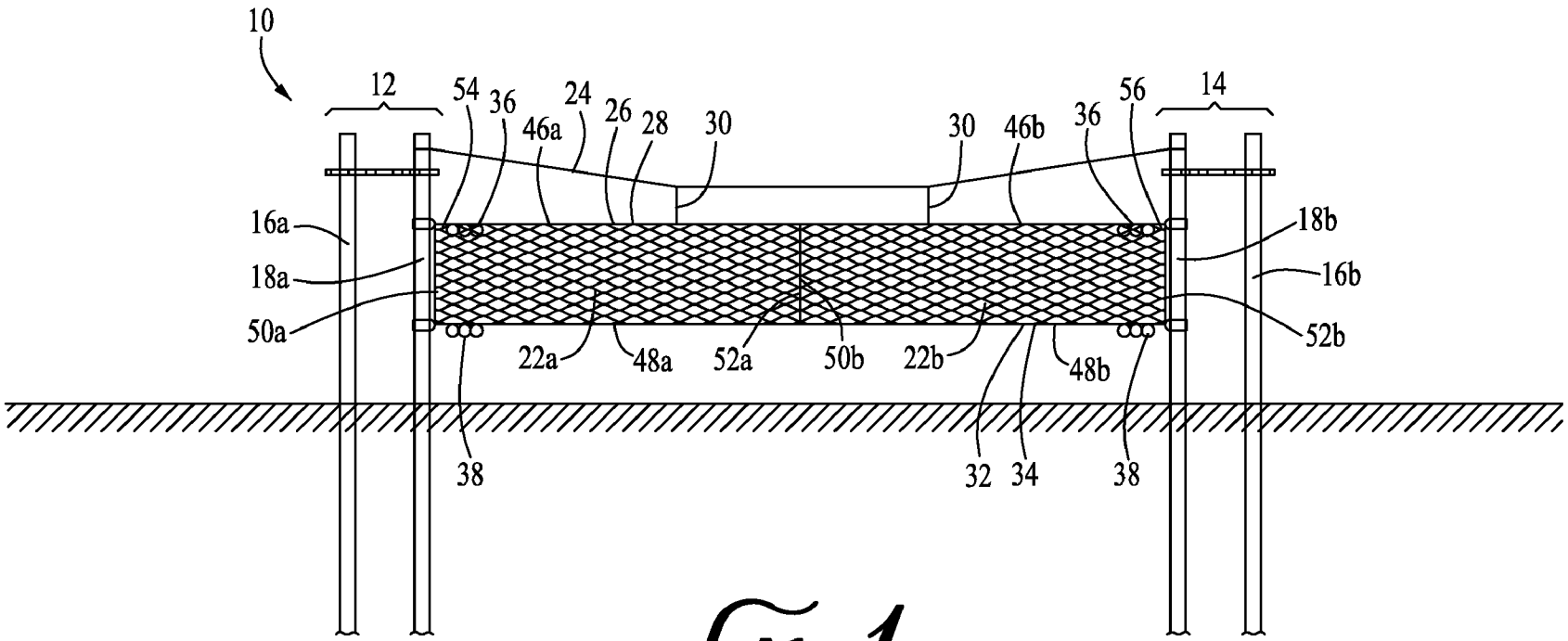
FIG. 1 is a front side illustration of a barrier according to one embodiment of the invention.
Figure 2:
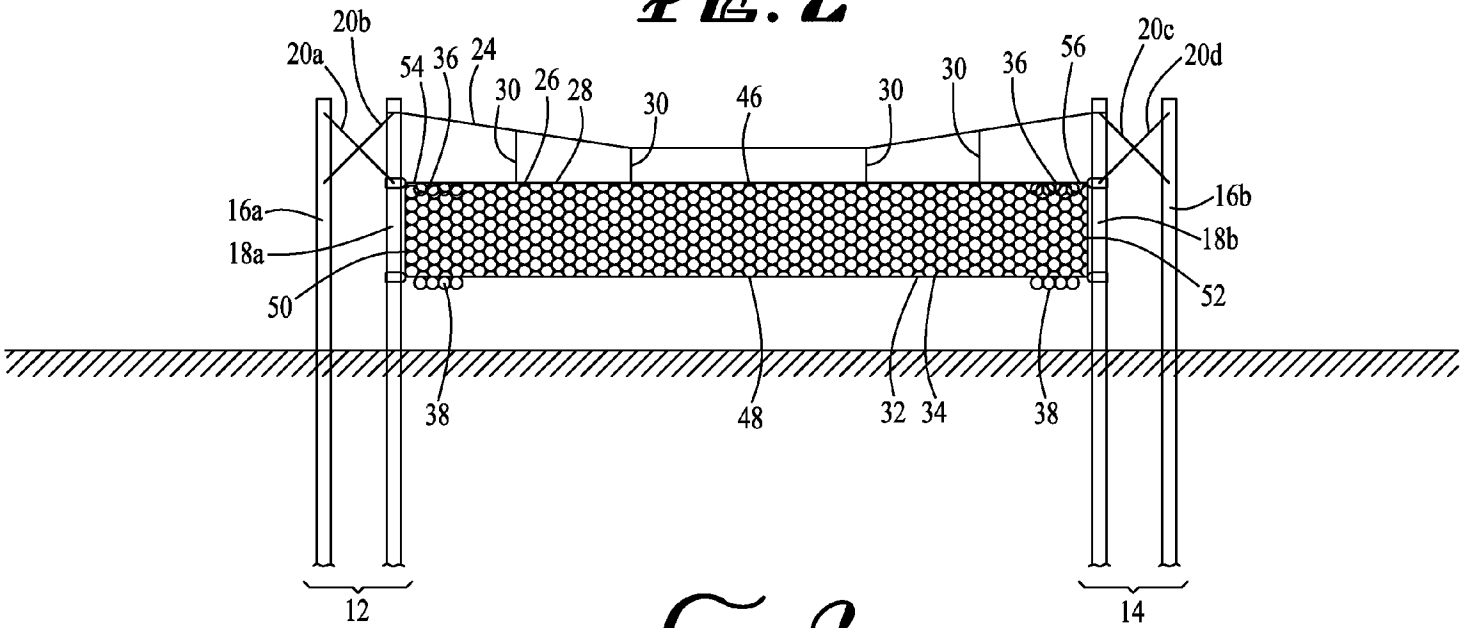
FIG. 2 is a front side illustration of a barrier according to another embodiment of the invention.

Referring now to FIGS. 1 and 2, a barrier 10 according to the present invention is shown. The barrier 10 comprises a first end support 12 and a second end support 14, which are structures that are grounded in a stationary position, substantially perpendicular to a body of water, e.g., a sea floor. A net 22 is assembled between the end supports 12 and 14 with a system of ropes 24, 26, 28, 30, 32, and 34 and one or more energy absorbing devices 36 and 38.

The end supports 12 and 14 are bottom, e.g., sea floor founded, and may be a steel piling, concrete piling, or spar arrangements of suitable size as to withstand applicable environmental energies. Accordingly, the supports are substantially stable such that they remain vertical and in a stationary position in adverse weather conditions and upon impact of the barrier with a vehicle. Preferably, the end supports are driven to a depth of about thirty-five feet below the floor of the body of water and rise about thirty feet above the water level.

In one embodiment of the invention, one or both of the first end support 12 and the second end support 14 comprise a set of two pilings that are coupled together, i.e., first vertical supports 16*a* and 16*b* and second vertical supports 18*a* and 18*b*. Preferably, the first vertical supports 16*a* and 16*b* are coupled to the second vertical supports 18*a* and 18*b* with a set of coupling wires 20*a*, 20*b*, 20*c*, and 20*d* in an "X" formation, as shown in FIG. 2. The wires may be coupled to the end supports using turn buckles that are joined to pad eyes which are welded to the end supports. However, the end supports 12 and 14 may be designed in a variety of configurations, such as one piling, which may have additional support tethers, or multiple pilings, coupled together by various methods as will be understood by those of skill in the art by reference to this disclosure.

Referring again to FIGS. 1 and 2, in one embodiment of the invention, a top rope 24, a first upper rope 26, and a second upper rope 28, are connected to the vertical supports 18*a* and 18*b*. The top rope 24 is installed with sufficient tension as to carry the weight of the net 22 in a horizontal orientation. A plurality of hanger ropes 30 connect the top rope 24 to the first upper rope 26 and the second upper rope 28. A first bottom rope 32 and a second bottom rope 34 are connected to the second vertical supports 18*a* and 18*b* in a position below the first upper rope 26 and the second upper rope 28.

Preferably, the top rope 24 is attached to the support at an elevation of about twenty-five feet above the water line, and the first upper rope 26 and the second upper rope 28 are attached to the supports about nineteen feet above sea level. However, this positioning may be varied according to the different heights of end supports and net used, and the different applications of the barrier, as will be understood by those of skill in the art by reference to this disclosure.

The barrier 10, may have a plurality of energy absorbing devices 36 connected to one or more of the ropes 26, 28, 32, and 34. As shown in FIGS. 1 and 2, in a preferred embodiment, a plurality of energy absorption devices 36 are connected to the first upper rope 26 and the second upper rope 28, and a plurality of energy absorption devices 38 are connected to the first bottom rope 32 and the second bottom rope 34. More preferably, at least one energy absorption device 36 is connected to the first upper rope 24 at a position proximate to the first end support 12, and at least one energy absorption device 36 is connected to the second upper rope 24 at a position proximate to the second end support 14. Also more preferably, at least one energy absorption device 38 is connected to the first bottom rope 32 at a position proximate to the first end support 12, and at least one energy absorption device 38 is connected to the second bottom rope 32 at a position proximate to the second end support 14.

Referring now to FIGS. 4*a*, 4*b*, and 4*c*, various embodiments of energy absorption devices 38 according to the present invention are shown. The energy absorption device 38 is a device that dissipates residual energy out of the net. Examples of suitable energy absorption devices 38 include, but are not exclusive to a brake ring, commercially available from Geobrugg Protection Systems, Romanshorn, Switzerland and/or a brake element manufactured by Rotec International, Santa Fe, N. Mex. However, other suitable energy absorption devices may be used in the invention, as will be understood by those of skill in the art by reference to this disclosure.

Referring again to FIGS. 4*a*, 4*b*, 4*c*, in one embodiment, the energy absorption devices 36 and 38 are braking devices 40. The braking device 40 shown in FIG. 4*a* is a double loop braking element, having a rope 41 that is double looped a guide 42. The braking device 40 shown in FIG. 4*b* is a single loop breaking element, having a rope 41 that is looped through a guide 42. The braking device 40 shown in FIG. 4*c* is a brake ring that is formed by guiding a bearing rope through a pipe 43 bent into a loop and held by a compression sleeve 44. FIG. 4*d* is a side perspective view of a barrier 10, showing a plurality of the braking devices 40 that are shown in FIG. 4*c*. FIG. 4*e* is a front perspective view of a barrier 10, showing a plurality of the braking devices 40 that are shown in FIG. 4*c*. The energy absorption devices shown in FIGS. 4*a*, 4*b*, and 4*c*, function as a braking device in a larger impact event when the brake ring contracts to dissipate residual energy out of the net 22, without damaging the ropes. The rope's breaking load is not diminished by activation of the brake ring 40. Preferably, one or more braking devices 40 is placed proximate to an end support, on each of the upper and bottom ropes. This arrangement gives strength to each of the ropes in a large impact event.

Referring again to FIGS. 1 and 2, the barrier 10 is comprised of a net 22 stretched between multiple vertical supports 12 and 14. These elements create an enclosure around a port or off-shore facility to be protected. The vertical support elements are designed to support the net system which extends to a height above high tide by at least fifteen feet and extends below the water surface by a distance defined or determined by environmental conditions and/or the level of underwater protection desired, and may extend to the floor of the water body, e.g., the sea floor. As shown in FIGS. 1 and 2, a net having a top 46, a bottom 48, a first side 50, and a second side 52 is connected to the first upper rope 26 and the second upper rope 28, and the bottom of the net 48 is connected to the first bottom rope 32 and the second bottom rope 34, such that the first side 50 is proximate to the first end support 12 and the second side 52 is proximate to the second end support 14. According to the present invention, the net 22 may comprise a series of net segments which are connected as shown in FIG. 1. According to this embodiment, the net 22 comprises a first net segment 22*a* and a second net segment 22*b*, where the first net segment 22*a* is connected to the second net segment 22*b*, and each net segment comprises a top 46*a* and 46*b*, a bottom 48*a* and 48*b*, a first side 50*a* and 50*b*, and a second side 52*a* and 52*b*, and wherein the top of each net segment 46*a* and 46*b* is connected to the first upper rope 26 and the second upper rope 28, the bottom of each net segment 48*a* and 48*b* is connected to the first bottom rope 32 and the second bottom rope 34, such that the first side 50*a* of the first net segment 22*a* is proximate to the first end support 12 and the second side 52*a* of the first net segment 22*a* is proximate to the first side 50*b* of the second net segment 22*b* and the second side 52*b* of the second net segment 22*b* is proximate to the second end support 14, and wherein the first net segment 22*a* is connected to the second net segment 22*b* at the second side 52*a* of the first net segment 22*a* and at the first side 52*b* of the second net segment 22*b*.

Figure 5A:
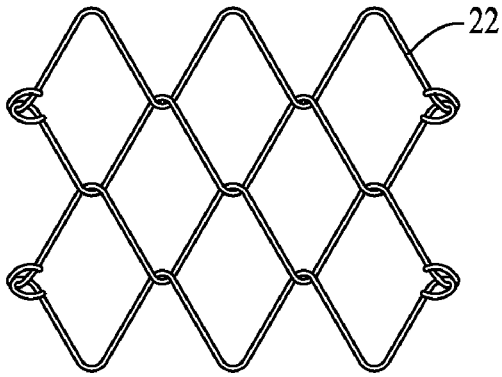
Figure 5B:
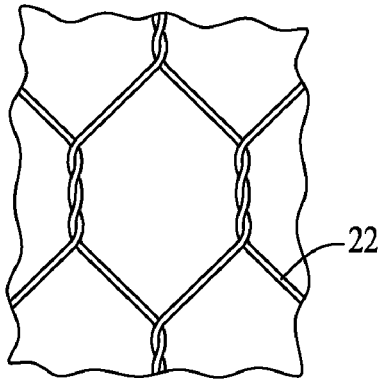
Figure 5C:
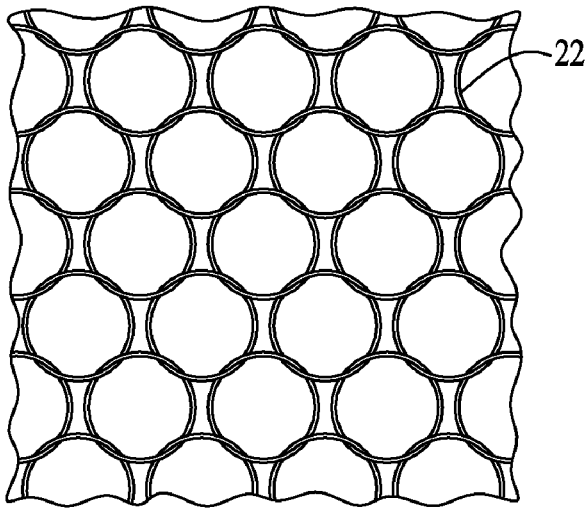
Figure 5D:
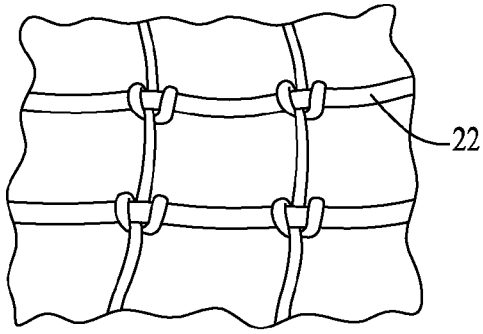
Figure 5E:
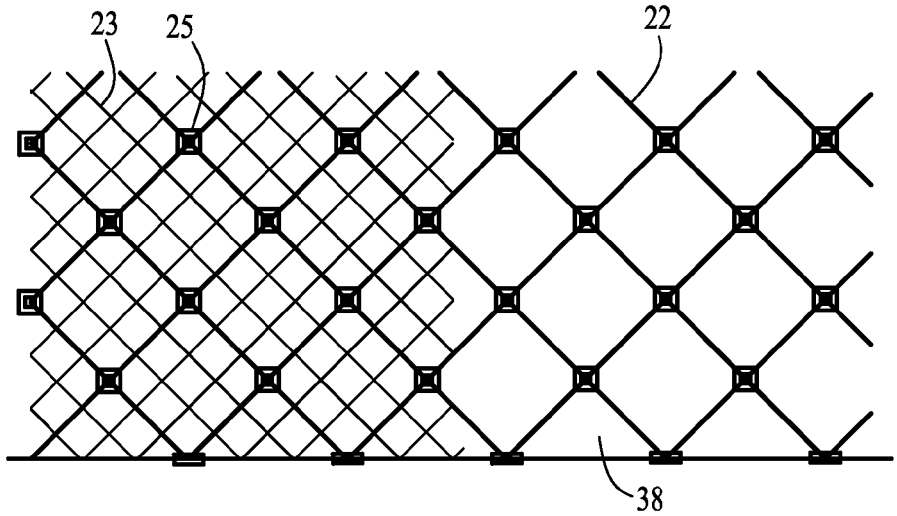
Figure 5F:
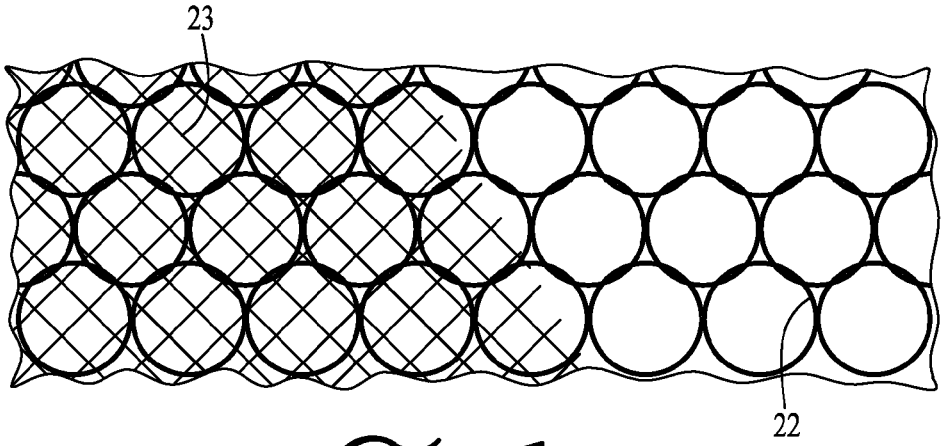

The net 22 may be comprised of various materials such as nylon, stainless steel, or various alloys. Examples of suitable nets include nylon nets commercially available from Net Systems, or metal netting commercially available from Rotec International, Maccaferri, and Geobrugg. The net 22 is preferably comprised of stainless steel having compliant elastic deformation. This promotes the consistent and regular transmission of dissipated energy throughout the net system. The net 22 first dissipates kinetic energy over the sum of the deformation and of all of the net sections. The energy forces are uniformly transferred into the net and/or into the whole system, without placing extreme stress on the supports. Referring now to FIGS. 5*a*-5*f*, a net 22 according to various embodiments of the present invention is shown. As shown in FIG. 5*a*, the net 22 is a diamond-shaped mesh pattern. As shown in FIG. 5*b*, the net 22 is a diamond-shaped pattern having a double twist in the pattern. As shown in FIG. 5*c*, the net 22 is a rope net comprising a plurality of interconnecting rings. As shown in FIG. 5*d*, the net 22, is a rectangular mesh pattern. As shown in FIGS. 5*e* and 5*f*, the net 22 may have a mesh 23, which may be fastened to the net 22 with a clip 25. However, the embodiments of the net 22 shown in FIGS. 5*a*-5*f*, are shown as examples, and other suitable nets may be used in the invention, as will be understood by those of skill in the art by reference to this disclosure.

According to the present invention, the barrier 10 may also comprise a first vertical rope 54 and a second vertical rope 56, wherein the first vertical rope 54 is connected to the first side 50 of the net 22 and the second vertical rope 56 is connected to the second side 52 of the net 22. When multiple net sections are joined together to form the net 22, the first vertical rope 54 is connected to the first side 50*a* of the first net segment 22*a* and the second vertical rope 56 is connected to the second side 52*b* of the second net segment 22*b*.

Referring now to FIG. 6*a* and FIG. 6*b* , a barrier system 60 according to the invention is shown. The barrier system 60 comprises a plurality of contiguous barrier units 62 that form a perimeter fence. At least one barrier unit 62 is a barrier 10 according to the invention described herein, and at least one barrier unit 62 operates as an access gate 64. The barrier system 60 may also be equipped with electronic surveillance, such as cameras 68*a* and 68*b* at multiple points on the perimeter fence, and may also be equipped with electronic tracking 66 for monitoring the approach of an aqueous vehicle. In one embodiment of the present invention, the barrier system 60 is a series of contiguous barrier units 62 that form a substantially circular perimeter around an off-shore structure. According to another embodiment of the present invention, shown in FIG. 6*b*, the access gate 64 is a floating barrier gate 64*a*, and according to another embodiment, shown in FIG. 6*a*, the access gate 64 is a vertical action gate 64*b*. Preferably, the access gate 64 is remotely operated.

Referring now to FIG. 7, according to another embodiment of the present invention, a method for stopping a high speed watercraft 70 in a body of water 72 is also provided. The method comprises providing a barrier 10 having a net 22 assembled between at least two vertical supports 12 and 14 with a system of ropes 24, 26, 28, 30, 32, and 34 and energy absorbing devices 36 and 38. The vertical supports 12 and 14 positioned in a substantially stationary position that is substantially perpendicular to the body of water 72. As shown in FIG. 7*a*, the watercraft 70 is moved through the body of water 72 at a high rate of speed in a direction substantially perpendicular to the barrier 10, thereby generating a kinetic energy.

Figure 7A:
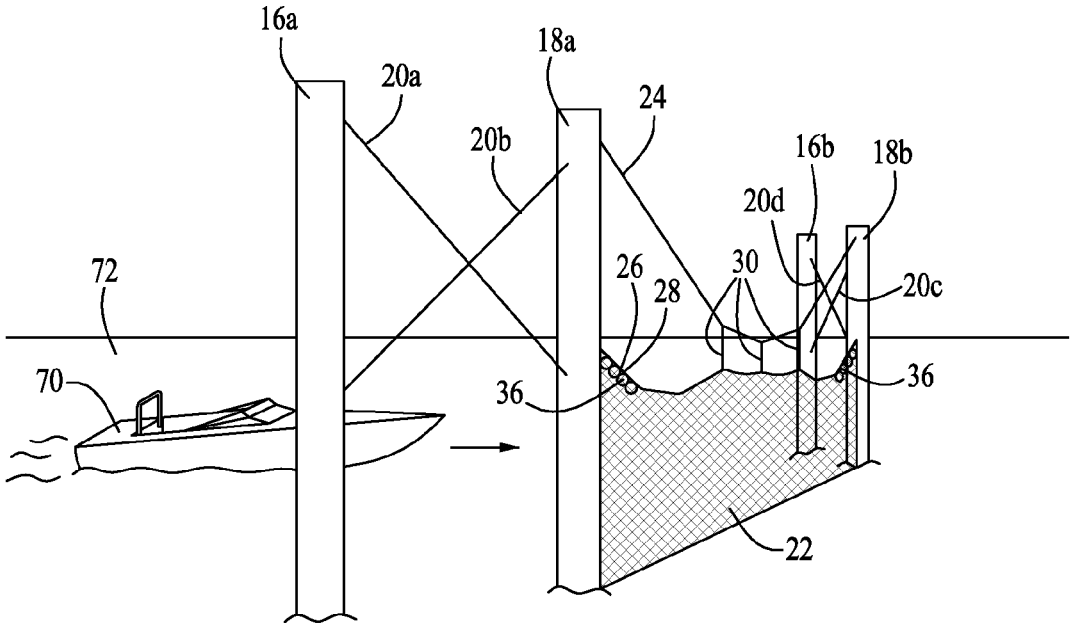
Figure 7B:
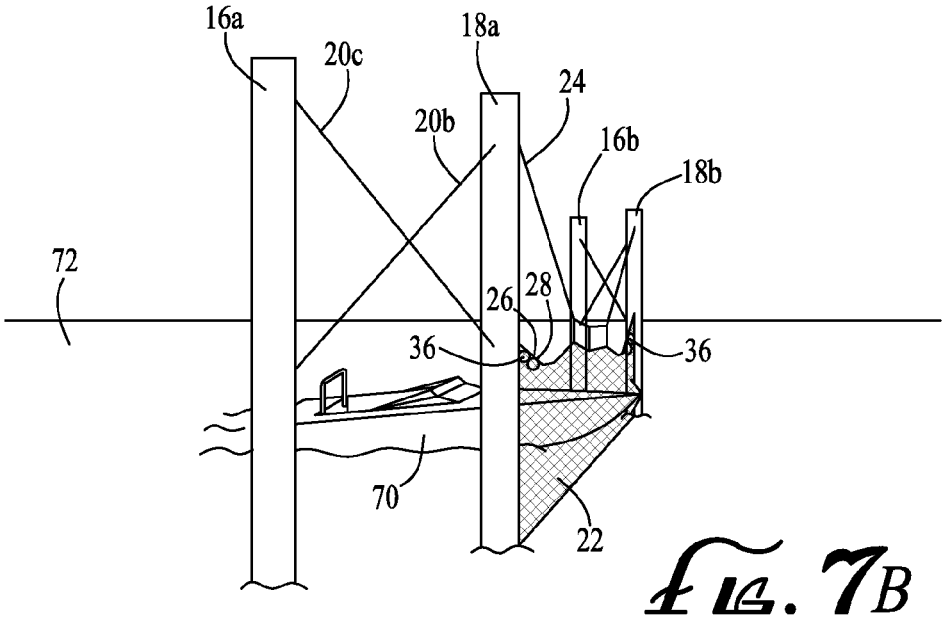
Figure 7C:
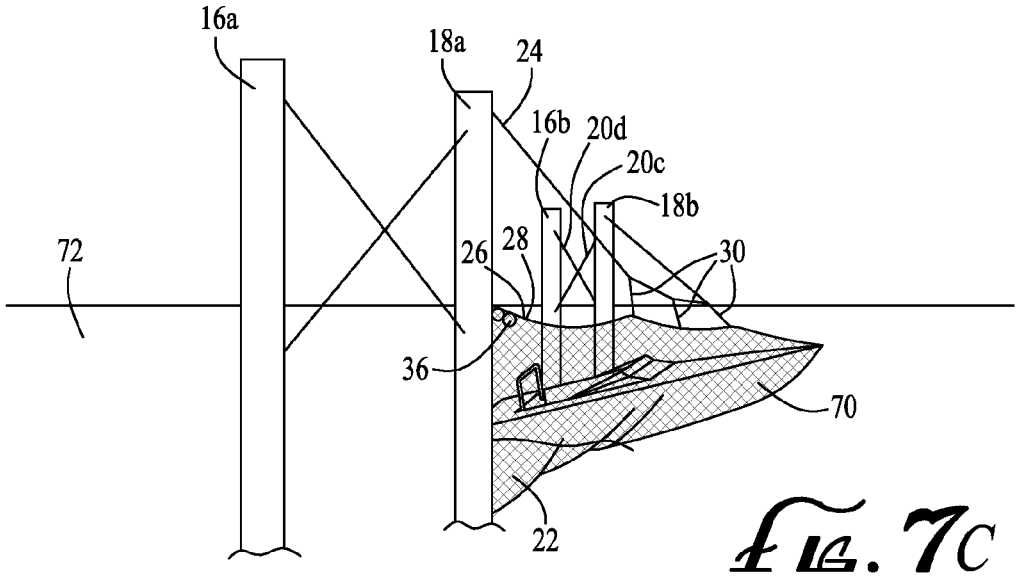
Figure 7D:
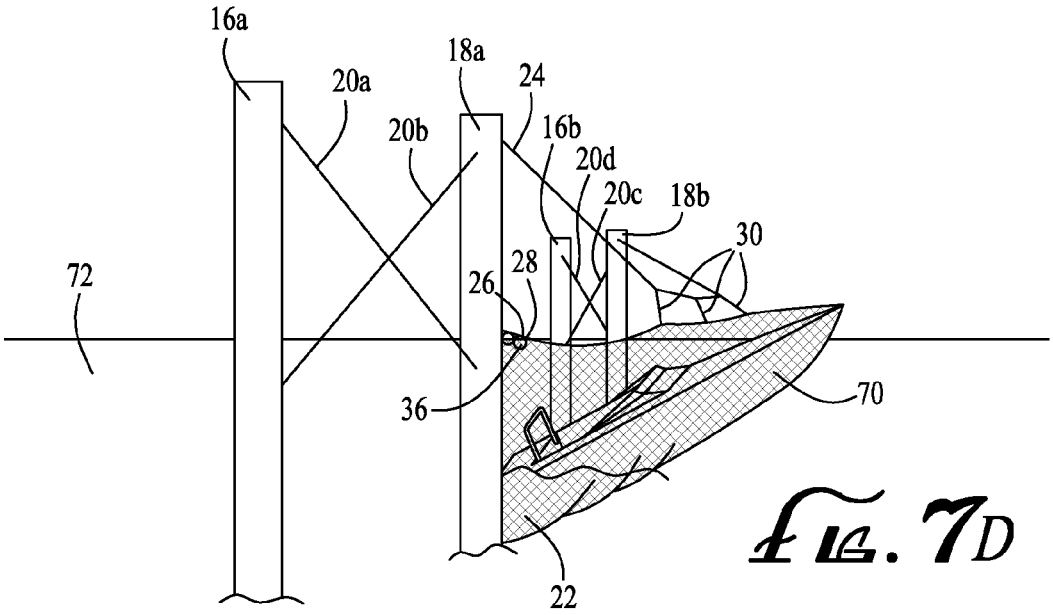
Figure 7E:
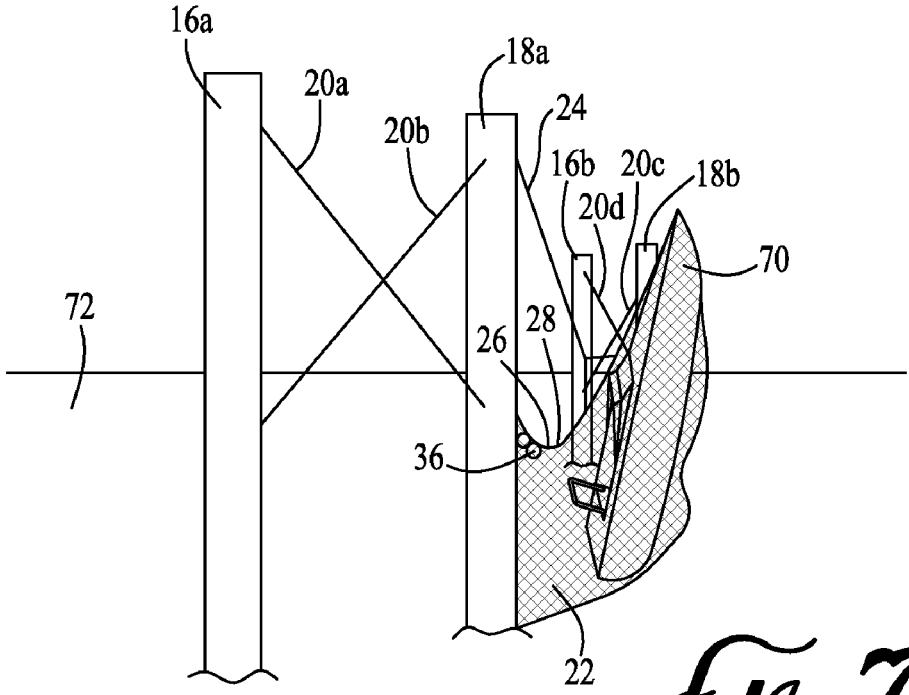
Figure 7F:
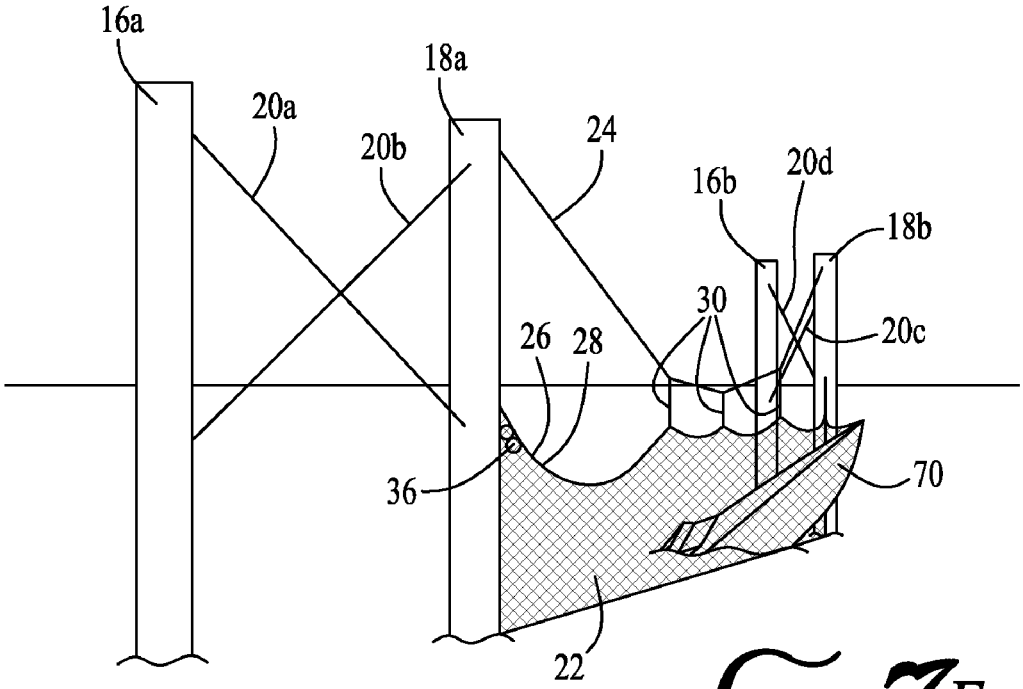

As shown in FIGS. 7*b* and 7*c*, the net 22 is contacted by the watercraft 70, and at least some of the kinetic energy is dissipated into the net 22. As shown in FIGS. 7*d* and 7*e*, the net structure vertically pitches the watercraft 70 in relation to the body of water, thereby converting at least some of the kinetic energy. The watercraft 70 is stopped, as shown in FIG. 7*f*, when the watercraft 70 drops backward into the body of water 72 where it may take on water. After these series of steps the barrier 10 and the watercraft 70 are substantially undeformed, and the vertical supports 12 and 14 are substantially unmoved from their stationary vertical position.

EXAMPLES

I. General Barrier Configurations for Barrier Tests

The barriers described below were installed offshore in Pascagoula, Miss. according to the description below. The following examples discuss the invention in considerable detail with reference to certain embodiments. However, other embodiments are possible. The scope of the invention should not be limited to the following examples and description of embodiments contained therein.

End Supports.

Figure 3:
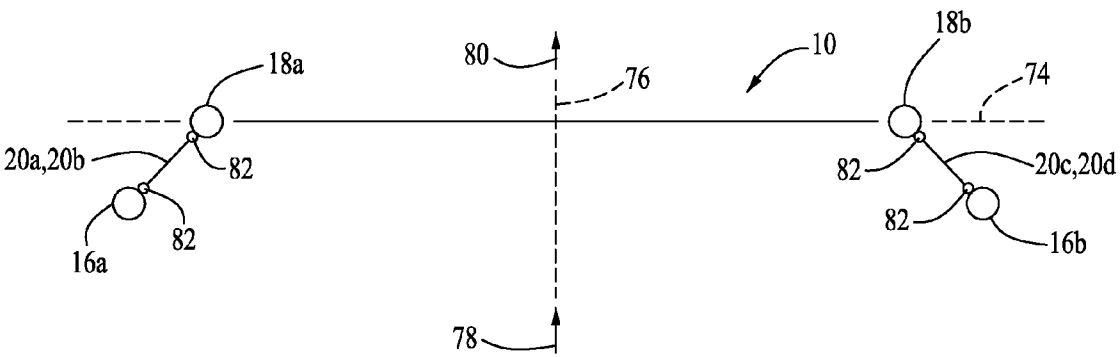
FIG. 3 is a top side illustration of the barrier illustrated in FIG. 2.

Referring again to FIGS. 1 and 2, and referring now to FIG. 3, a top side illustration of the barrier 10 is shown. The first vertical supports 16*a* and 16*b* and the second vertical supports 18*a* and 18*b*, which were each twenty-four inch diameter, forty by sixty-five ft (40×65 ft) long pilings, (A53 grade "B", (42 KSI)), purchased from Skyline Steel, Mandeville La., were driven to an embedment depth of −35 ft below the sea floor utilizing a V-30 MKT vibratory hammer. The supports were hoisted in the air using a 100 ton American 7260 crawler crane. Referring again to FIG. 3, for the purpose of the barrier tests described herein, the barrier 10 was designated as the transverse centerline 74 of the test range, and the direction of the oncoming watercraft 70, with respect to the transverse centerline 74 of the barrier 10, was designated as a longitudinal centerline 76 of the barrier test range. The direction of the oncoming watercraft 70, with respect to the transverse centerline 74 of the barrier 10, was designated as the "uphill" direction 78, and the direction away from the barrier 10 was designated as the "downhill" direction 80. The vertical supports 16*a*, 16*b*, 18*a*, and 18*b*, were arranged in two sets of two, two to the left of the longitudinal centerline 16*a* and 18*a*, and two to the right of the longitudinal centerline 16*b* and 18*b*. The vertical supports 18*a* and 18*b* were driven fifty feet offset in a direction perpendicular to the longitudinal centerline in each direction, one support 18*a* was driven to the left and one support 18*b* was driven to the right. The two remaining supports 16*a* and 16*b*, were driven sixty feet offset in a direction perpendicular to the longitudinal centerline and ten feet offset in a direction transverse and uphill. Pad eyes 82 obtained from EDCO, Mount Vernon, Wash. were welded in the appropriate orientation and elevation on each vertical support 16*a*, 16*b*, 18*a*, and 18*b*. On each vertical support, upper pad eyes 82 were welded one foot down from the top of the pilings at an elevation of +25 feet and lower pad eyes 82 were welded six feet below the upper pad eyes 82 at an elevation +19 feet. As shown in FIG. 3, the pad eyes 82 were oriented by looking down onto the tops of the piling and orientating the pad eye locations according to clock positions as follows: (i) on the left side of the longitudinal centerline, on the vertical support 18*a*, pad eyes 82 were installed at a 7:30 clock position; (ii) on the left side of the longitudinal centerline, on the vertical support 16*a*, pad eyes were installed at a 1:30 clock position, the 7:30 clock positioned pad eyes looking in the direction of the 1:30 clock positioned pad eyes; (iii) on the right side of the longitudinal centerline, on the vertical support 18*b*, pad eyes were installed at a 4:30 clock position; and (iv) on the right side of the longitudinal centerline, on the vertical support 16*b*, pad eyes were installed at a 10:30 clock position, the 4:30 clock positioned pad eyes looking in the direction of the 10:30 clock positioned pad eyes.

Each set of two supports, i.e., 16*a* and 18*b*, and 16*b* and 18*b*, were coupled to together by a ¾" wire rope 20*a*, 20*b*, 20*c*, and 20*d*, obtained from Washington Chain and Supply, Seattle Wash., turn buckles obtained from Washington Chain and Supply, Seattle Wash., and shackles, obtained from Washington Chain and Supply, Seattle Wash. in an "X" formation at the upper elevation of the supports. To couple the pilings, a one inch 6×19 IPS section of the wire rope was cut to the correct length, measured diagonally from the upper welded pad eye down to the opposing lower pad eye located on the adjacent pile. The length of an opened turn buckle and shackle were subtracted from the length measured. Eyes were spliced into the wire rope. This process was repeated three more times. The wire rope was installed with one inch shackles and turnbuckles. Slack was taken out of the coupling devices by tightening the turn buckles.

Rope System.

Upon completion of the support installation, the rope system was then installed.

Referring again to FIGS. 1 and 2, the top rope 24 (catenary rope) was installed with sufficient slack as to carry the weight of the net sections in a horizontal or plumb orientation. The top rope 24 was connected to the vertical supports 18*a* and 18*b* using standard 1' screw pin shackles. Hanger ropes 30, i.e., break-away ropes, were then connected to the top rope 24 using standard twenty-two millimeter (22 mm) cable clips Washington Chain and Supply, Seattle Wash. Two upper support ropes, i.e., the first upper rope 26 and the second upper rope 28, were then connected to the vertical supports 18*a* and 18*b* at an elevation of +19 ft. Each of the two support ropes were terminated at piling pad eyes 82. On the right side of the first upper support rope 26, four energy absorbing devices 36 i.e., braking devices, were installed in line with the second upper support rope 28. On the left side the first upper support rope 26, four each energy absorbing devices 36 were installed in line with second upper support rope 28. This process was repeated for the bottom ropes 32 and 34, installing four energy absorbing devices 38 on each side of the bottom ropes 32 and 34, for a total of eight devices 38, proximate to the supports 18*a* and 18*b*. Between the piling pad eye and the hard eye of each first upper support rope 26 a load cell was installed to record peak loads during the impact event.

The upper support ropes 26 and 28 were terminated at a welded pad eye on the supports 18*a* and 18*b*. Slack was removed from the upper support ropes 26 and 28 with the use of com-a-long and cable grips. The bitter end of the support rope was passed through a one and a half inch shackle, two cable grips were used this point, one for a purchase point on the stationary end of the com-a-long, and the other cable grip was utilized for the hoisting end of the com-a-long. The second cable grip was installed on the dead end of the upper support ropes. Once the slack was removed, standard 22 mm cable clamps were installed to hold the upper support ropes in tension. After installation of the upper support ropes the lower support rope were installed in the same manner as the upper support ropes.

Net Installation.

Next, the net 22 was installed in the barrier 10. Two net segment panels 22*a* and 22*b*, were shackled to both upper support ropes 26 and 28 using three-quarter inch shackles. After two net segments were hung from the upper support ropes 26 and 28, each net segment was then shackled to the adjoining net segment with five-eighth inch (⅝") shackles. This process was continued until all the net segments were hung and joined to their adjacent net segments. Then, the joined net segments were pulled to either the left or right support 18*a* or 18*b*, and connected to the vertical end ropes 54 and 56 with three-quarter inch (¾") shackles. Once the left or right side of the net 22 is connected to a vertical end ropes, then the opposite side may be shackled to a vertical end rope. The last step in preparing the net for testing was to secure the net segments 22 to both bottom ropes 32 and 34. Each of the net openings was shackled into the bottom ropes 32 and 34 with ¾" shackles.

Data Recording.

The load cell, obtained from Naval Facilities Engineering Command Center (NFESC), Port Hueneme Calif. was installed to record peak loads during the impact event. A tensiometer, obtained from Naval Facilities Engineering Command Center (NFESC), Port Hueneme Calif. was also installed. The load cells and tensiometers were checked by having the test boat push on the net 22. The signal was sent to data recorders and confirmation was made that the load cells and tensiometers were functioning properly.

Testing.

The test boats were outfitted with remote control devices which enabled the operator in a chase boat to follow at a safe distance behind the test boat. Several passes were made to ensure that all systems were functioning correctly. Once all systems checked out, the test boat was positioned uphill away from the barrier approximately one-half mile. All personnel were cleared from the area. The chase boat was positioned 500 ft behind the test boat. The test boat was brought up to speed (42 mph) and run into the net section of the barrier. After impact, all data recorders were switched to off and the test boat was removed from the test range.

II. Barrier Tests 1 & 2

A barrier according to the general barrier configurations described above was constructed using a chain link fence, obtained from Geobrugg Protection Systems, FATZER AG, Geobrugg Protection Systems, Romanshorn, Switzerland, as the net structure. The net was a system of 3×4.7 mm wires interwoven in a diamond pattern of approximately 280×445 mm. In this test, a 4 meter high by 30.48 meter long test section of the net was tested. A boat named "Lake of the Ozarks", a 7,450 pound (3380 kg), 600 horse power (Hp) boat was used as the test boat. Two tests, Test 1 and Test 2, were completed and recorded according to the testing procedure described above with the chain link net barrier and the "Lake of the Ozarks" boat impacting the net on each test. Selected details of these tests are shown in Table 1 below.

III. Barrier Test 3

A barrier according to the general barrier configurations described above was constructed using a wire ring fence, obtained from Geobrugg Protection Systems, FATZER AG, Geobrugg Protection Systems, Romanshorn, Switzerland, as the net structure. The wire ring fence was a system of 12 strands of 3 mm wire clamped into 300 mm diameter rings. In this test, a 4 meter high by 30.48 meter long test section of the net was tested. A boat named "Palm Bay", an 8,000 pound (3630 kg), 660 horse power (Hp) boat was used as the test boat. One test, Test 3 was completed and recorded according to the testing procedure described above with the wire ring net barrier and the "Palm Bay" boat impacting the net on the test. Selected details of this test are shown in Table 1 below.

TABLE 1

| Test | Boat Speed (kts) | Boat Speed (m/s) | KE (k ft*lbf) | KE (kJ) |
|---|---|---|---|---|
| 1 | 25.2 | 12.96 | 209 | 284 |
| 2 | 28.2 | 15.74 | 309 | 418 |
| 3 | 35.4 | 18.2 | 443 | 601 |

IV. Test Results

Two full-scale boat crash tests were conducted with the chain link barrier, Tests 1 and 2, and one full-scale boat crash test was conducted with the wire ring net barrier. FIG. 7 is an illustration of the results of the boat crash tests. As shown in FIG. 7, the boat is directed to the barrier and contacts the net. Some of the kinetic energy of the boat is dissipated by the barrier. As the boat proceeds into the net, the bow pitches vertically upward and converting some of kinetic energy. Then, the boat stops and slowly drops backward into the water, taking on some water.

The two tests conducted on the chain link barrier, Tests 1 and 2, were conducted on the same segment of the net. The same barrier stopped both oncoming boats in less than one boat length (0.55 boat length for 209,000 ft*lbf of oncoming kinetic energy and 0.68 boat lengths for 309,000 ft*lbf of oncoming kinetic energy). There was no significant structural damage to the barrier, except for localized deformation to the net. The test boats were not structurally damaged, except for taking on some water.

The wire ring barrier test, Test 3, had over twice the kinetic energy of Test 1, and 43% higher energy than Test 2. At this higher energy, and with the boat engines on, the boat became almost vertical after stopping and drifting backwards. There was effectively no damage to the net in Test 3, except for some minor localized deformation. The boat was not damaged, except for taking on water.

The experimental results described above highlight the effectiveness of the invention in multiple ways. First, by supporting the net elements from a bottom founded structure the barrier remains stable in areas of open or in locations where environmental effects are too severe to allow the installation of a prior art floating system. By reducing the movement of the system, friction is eliminated and maintenance costs are reduced. Also, by eliminating the flotation devices e.g., pontoons, used in prior art systems, the system is not subjected to the same environmental effects of wind, waves, and currents. As shown in the above tests, the barrier according to the present invention can remain intact and structurally sound after multiple boat attacked. In contrast, tests of a prior art floating system after an impact event have shown that the net is displaced from the flotation structure rendering the system ineffective against additional or multiple attacks.

Although the present invention has been discussed in considerable detail with reference to certain preferred embodiments, other embodiments are possible. Therefore, the scope of the appended claims should not be limited to the description of preferred embodiments contained herein.

What is claimed is:

1. A barrier for protecting a port or off-shore structure, the barrier comprising:

a first end support;

a second end support;

a top rope connected to the first end support and the second end support, a first upper rope connected to the first end support and the second end support;

a second upper rope connected to the first end support and the second end support;

a first bottom rope connected to the first end support and the second end support;

a second bottom rope connected to the first end support and the second end support;

a plurality of hanger ropes connecting the top rope to both the first upper rope and the second upper rope;

a plurality of energy absorption devices connected to one or both of the first upper rope and the second upper rope;

a plurality of energy absorption devices connected to one or both of the first bottom rope and the second bottom rope; and a net having a top, a bottom, a first side, and a second side, wherein the top of the net is connected to the first upper rope and the second upper rope, and the bottom of the net is connected to the first bottom rope and the second bottom rope, such that the first side of the net is proximate to the first end support and the second side of the net is proximate to the second end support.

2. A barrier according to claim 1 further comprising first and second vertical ropes, wherein the first vertical rope is connected to the first side of the net and the second vertical rope is connected to the second side of the net.

3. A barrier according to claim 1 wherein the net comprises a first net segment and a second net segment and wherein the first net segment is connected to the second net segment, and wherein each net segment comprises a top, a bottom, a first side, and a second side, and wherein the top of each net segment is connected to the first upper rope and the second upper rope, the bottom of each net segment is connected to the first bottom rope and the second bottom rope, such that the first side of the first net segment is proximate to the first end support, the second side of the first net segment is proximate to the first side of the second net segment, and the second side of the second net segment is proximate to the second end support, and wherein the first net segment is connected to the second net segment at the second side of the first net segment and at the first side of the second net segment.

4. A barrier according to claim 3 further comprising first and second vertical ropes, wherein the first vertical rope is connected to the first side of the first net segment and the second vertical rope is connected to the second side of the second net segment.

5. A barrier according to claim 1 wherein one or both of the first end support and the second end support comprises a first vertical support member and second vertical support member that are coupled together.

6. A barrier according to claim 1 wherein the at least one of the energy absorption devices is a braking device.

7. A barrier according to claim 1 wherein at least two of the energy absorption devices are braking devices, at least one braking device being connected to the first upper rope at a position proximate to the first end support, and at least one braking device being connected to the second upper rope at a position proximate to the second end support.

8. A barrier according to claim 1 wherein at least two of the energy absorption devices are braking devices, at least one braking device being connected to the first bottom rope at a position proximate to the first end support, and at least one braking device being connected to the second bottom rope at a position proximate to the second end support.

9. A barrier according to claim 1 wherein the net is comprised of one or more materials selected from the group consisting of: nylon, stainless steel and metal netting.

10. A barrier according to claim 1 wherein the net has a pattern selected from the group consisting of: a net having a diamond-shaped mesh pattern, a net having a rectangular mesh pattern, and a net having a plurality of interconnecting rings.

11. A barrier according to claim 1 wherein the first support and the second support are pilings driven into a floor of a water body, and the bottom of the net extends to the floor of the water body.

12. A barrier for protecting a port or off-shore structure, the barrier comprising:

a first end support;

a second end support;

a top rope connected to the first end support and the second end support, a first upper rope connected to the first end support and the second end support;

a second upper rope connected to the first end support and the second end support;

a first bottom rope connected to the first end support and the second end support;

a second bottom rope connected to the first end support and the second end support;

a plurality of hanger ropes connecting the top rope to both the first upper rope and the second upper rope;

a plurality of energy absorption devices connected to the first upper rope, wherein at least two of the energy absorption devices are braking devices, at least one braking device being connected to the first upper rope at a position proximate to the first end support, and at least one braking device being connected to the first upper rope at a position proximate to the second end support;

a plurality of energy absorption devices connected to the second bottom rope, wherein at least two of the energy absorption devices are braking devices, at least one braking device being connected to the second bottom rope at a position proximate to the first end support, and at least one braking device being connected to the second bottom rope at a position proximate to the second end support, a net having a top, a bottom, a first side, and a second side, wherein the top of the net is connected to the first upper rope and the second upper rope, and the bottom of the net is connected to the first bottom rope and the second bottom rope, such that the first side is proximate to the first end support and the second side is proximate to the second end support;

a first vertical rope connected to the first support and the first side of the net; and a second vertical rope connected to the second support and the second side of the net.

13. A barrier system for protecting a port or off-shore structure, the system comprising:

a plurality of contiguous barrier units that form a perimeter, wherein at least one barrier unit is the barrier according to claim 1; and at least one barrier unit operates as an access gate.

14. A barrier system according to claim 13 further comprising electronic surveillance.

15. A barrier system according to claim 13 further comprising electronic tracking for monitoring the approach of an aqueous vehicle.

16. A barrier system according to claim 13 wherein the contiguous barrier units form a substantially circular perimeter around an off shore structure.

17. A barrier system according to claim 13 wherein the access gate is a floating barrier gate.

18. A barrier system according to claim 13 wherein the access gate is a vertical action gate.

19. A barrier system according to claim 13 wherein the access gate is remotely operated.

* * * * *